US005130022A

United States Patent [19]

Chara

[11] Patent Number: 5,130,022

[45] Date of Patent: Jul. 14, 1992

[54] DRAINAGE ELEMENT FOR PRESSES

[75] Inventor: Alexander Chara, Neuhausen, Switzerland

[73] Assignee: Bucher-Guyer AG Maschinenfabrik, Niederweningen, Switzerland

[21] Appl. No.: 556,369

[22] Filed: Jul. 24, 1990

[30] Foreign Application Priority Data

Aug. 22, 1989 [CH] Switzerland ..... 3041/89

[51] Int. Cl.[5] ..... B30B 9/02

[52] U.S. Cl. ..... 210/450; 210/451; 210/455; 210/462; 210/463; 100/107; 100/125

[58] Field of Search ..... 210/323.2, 386, 438, 210/445, 450, 452, 455, 459, 463, 479, 770, 350, 448, 460, 462; 100/107, 125, 211

[56] References Cited

U.S. PATENT DOCUMENTS 3,207,064 9/1965 Hauser-Bucher ..... 100/107
3,951,058 4/1976 Hauser ..... 100/107
4,475,451 10/1984 Hartmann ..... 100/107

FOREIGN PATENT DOCUMENTS 413599 12/1966 Switzerland ..... 100/107

*Primary Examiner*—W. Gary Jones
*Assistant Examiner*—Matthew O. Savage
*Attorney, Agent, or Firm*—Edmund M. Jaskiewicz

[57] ABSTRACT

To fasten filter covering (4) of a drainage element (2) for a fruit press, rod-shaped, flexible core (3) of drainage element (2) carries an elastic sleeve (11) on its end. Filter covering (4) is pulled over sleeve (11) and is held by an O-ring (13) in a annular slot (14) of sleeve (11). The end of drainage element (2) is detachably fastened in a holder (6) that is placed in container wall (5) of the fruit press to be axially immovable and that overlaps filter covering (4) and O-ring (13). During pulling action on filter covering (4) in the direction of arrow (17), annular slot (14) and O-ring (13) are deformed so that O-ring (13) acts as a wedge and solidly braces filter covering (4) against sleeve (11).

11 Claims, 4 Drawing Sheets

DRAINAGE ELEMENT FOR PRESSES

Figure 1:
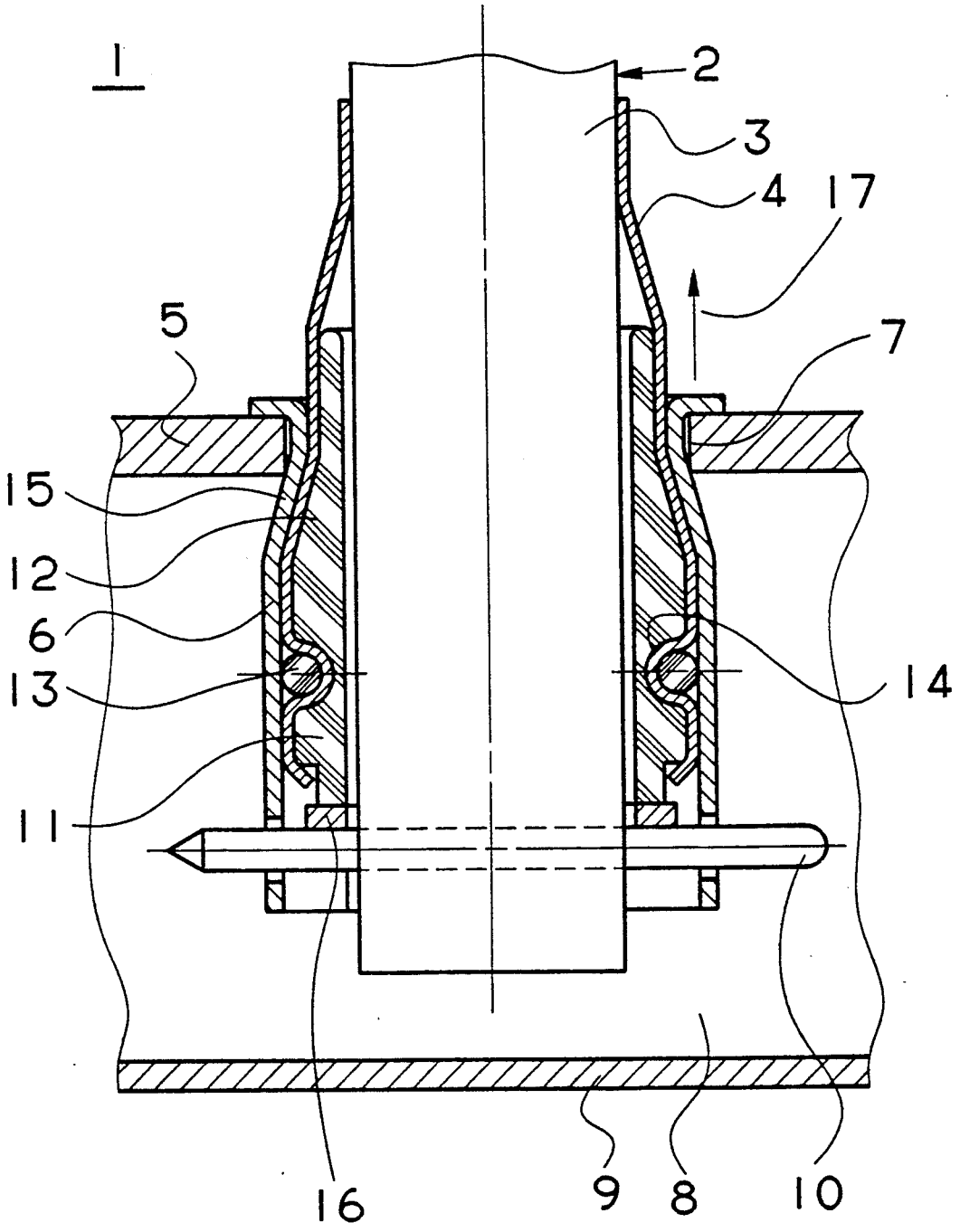

The invention relates to a drainage element for presses for separating liquids from solid substances, in particular for presses for fruits, grapes or produce, consisting of a core fastened in a holder connected to the outer wall of the container, made rod-shaped and surrounded by a liquid-permeable filter covering.

A sizable number of such drainage elements are placed, for example, in the pressing chamber of a fruit press exhibiting a pneumatically operated membrane on the container wall above or below the juice collecting channels. During pressing, the flexible drainage elements, projecting into the pressing chamber, deform. In doing so, the pressed-out juice penetrates the filter covering of the drainage element and is conveyed along the rod-shaped core out of the pressing chamber and guided into juice collecting channels. For this purpose, the respective end of the drainage element is fastened detachably in a holder connected to the container wall, and the core, provided with lengthwise grooves to transport the liquid, projects into a juice collecting channel.

To fasten the core, a sleeve tightly surrounding it is provided that exhibits, on the end facing away from the pressing chamber, a flanged edge, and between the sleeve and the holder there is fixed a socklike filter covering inverted around the holder toward the outside, and to secure the core in the axial direction, a pin that goes through the core and that lies on the flanged edge of the sleeve is provided and an insert is provided between the end of the core and the bottom of the juice collecting channel.

The drawback of this known embodiment is that the filter covering, in the area of the transition point at which the drainage element projects out of the holder into the pressing chamber, is pressed by the pressing force into the lengthwise-running drain grooves of the core and thus impairs the drainage.

At this point, because of the frequency movements of the core, a high load with corresponding wear occurs.

The object of the invention is to avoid said drawbacks and to provide a fastening of the drainage element whose production is simple and makes rapid assembly and functionality possible.

According to an advantageous feature of the invention, the retaining ring is placed in a annular slot provided on the sleeve or on the holder.

In this way, a compact construction can be achieved.

According to another feature of the invention, the retaining ring is made as an O-ring.

To protect the filter covering and the core, the sleeve is made of an elastic material.

Preferably the annular slot provided in the sleeve exhibits a recess angle running at approximately a right angle to the pull direction of the filter covering.

During pulling action on the filter covering, an elastic deformation of the annular slot and of the O-ring occurs and the O-ring acts as a wedge and presses the filter covering against the side of the annular slot.

In another embodiment of the invention, in which the sleeve consists of a less elastic, or nonelastic, material, the recess angle is greater than 90°.

To secure the sleeve axially toward the pressing chamber, the sleeve exhibits an outside cone that tapers toward the pressing chamber and that interacts with a corresponding inside cone of the holder, and the filter covering is placed between the sleeve and the holder.

The axial securing of the sleeve toward the liquid collecting chamber is performed by a detachable pin that is placed on the end of the core and that goes through a bore each of the core and of the holder.

Suitably, an end plate is placed between the sleeve and the pin.

According to another feature of the invention, the retaining ring or the O-ring assumes the function of sealing the solids out of the pressing chamber.

The advantages achieved with the invention consist also in that, because of the wedge effect of the O-ring, the holding force increases with increasing tensile force on the filter covering and thus an assured fastening is guaranteed also with high tensile forces. The structure of the fastening permits a thin-walled design of the holder in which the drainage element is inserted for anchoring purposes. In this way, low material costs and a low-cost production result. Further, the assembly and disassembly of the filter covering is simplified and made easier.

Figure 2:
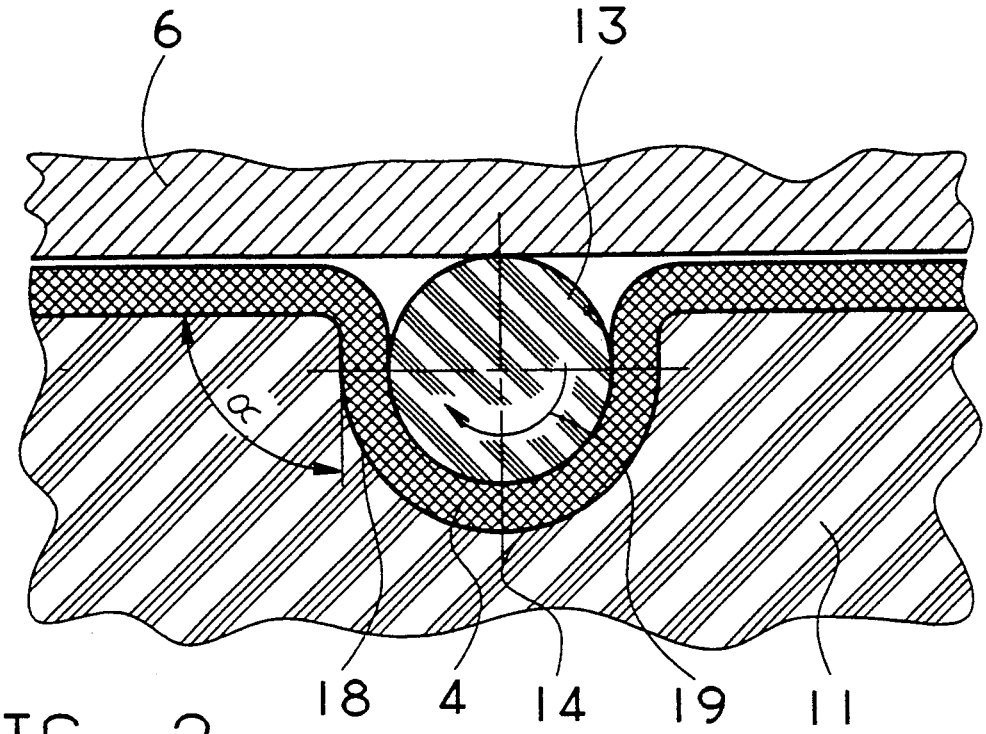
Figure 3:
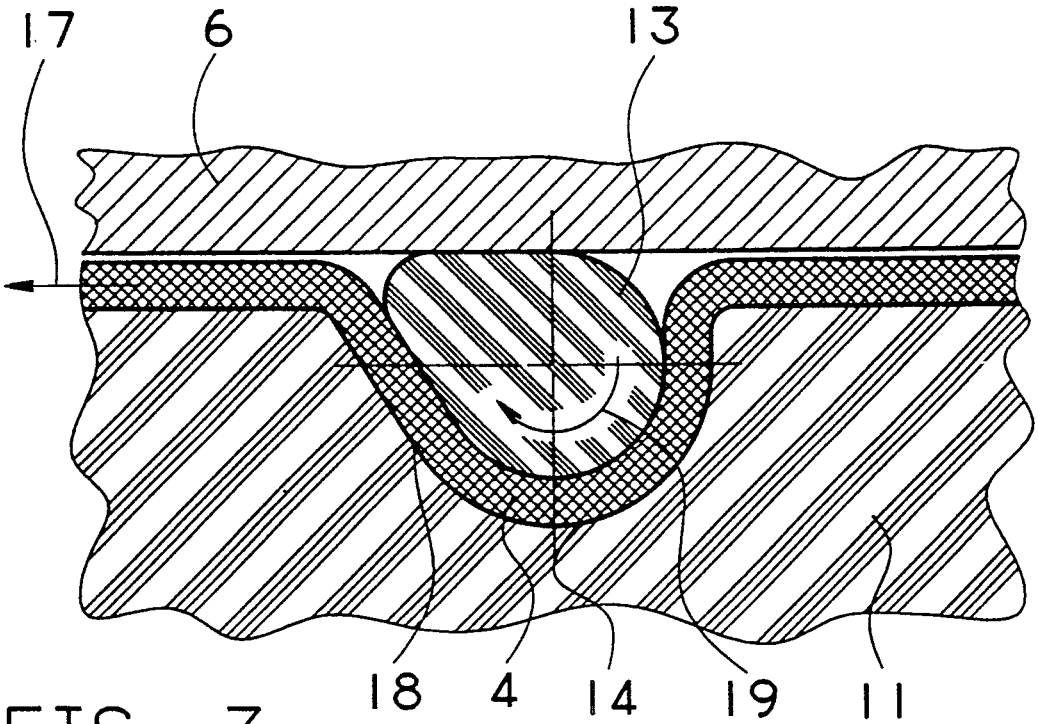
Figure 5:
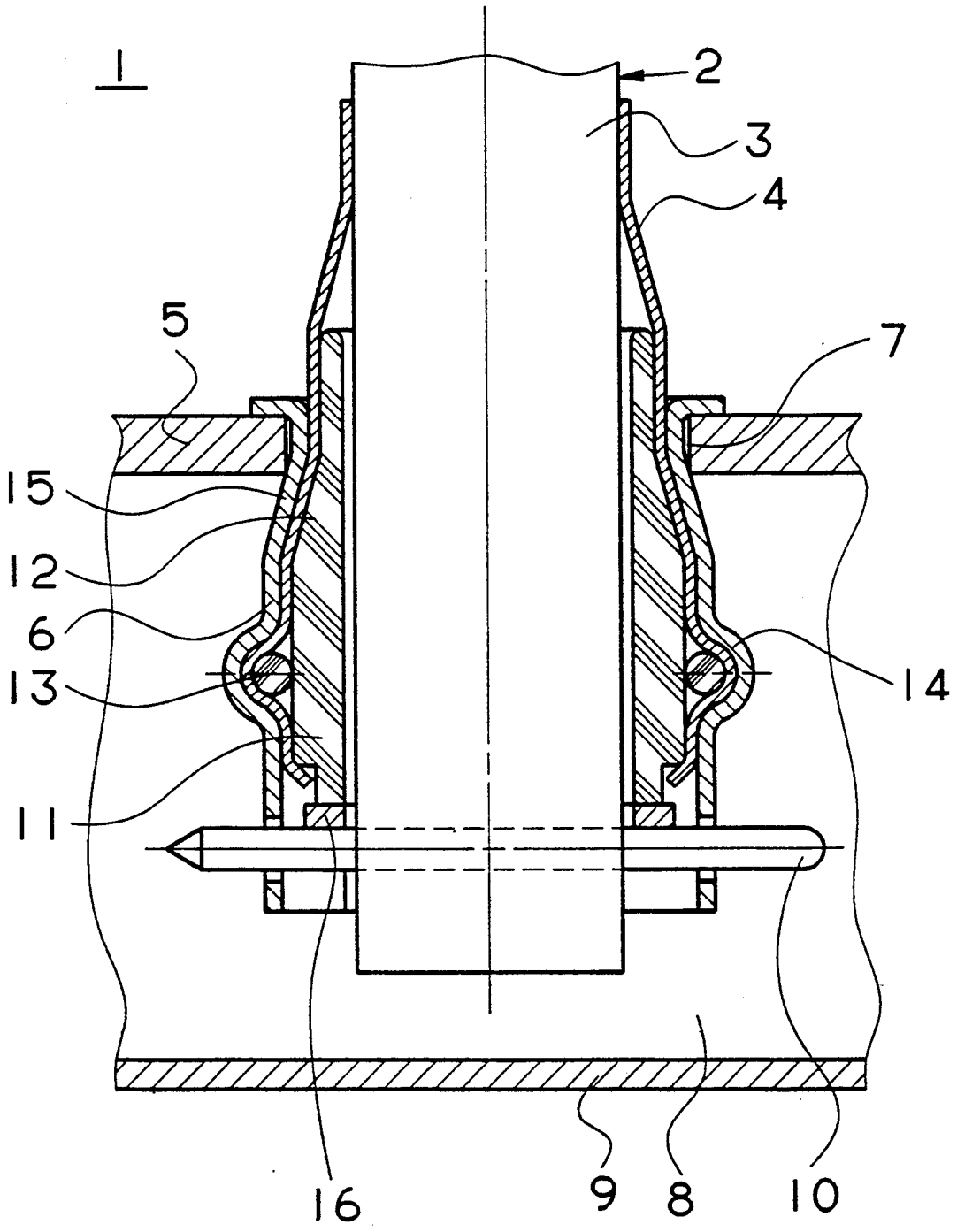
Figure 4:
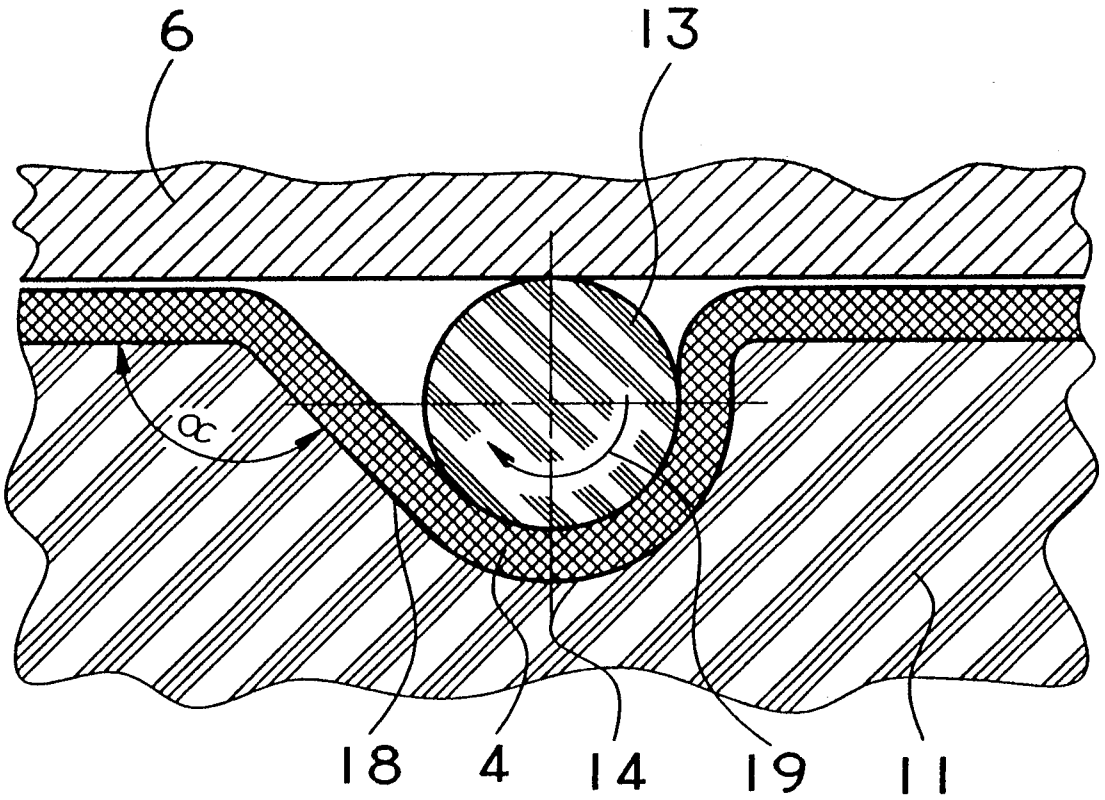

The invention is explained in more detail in the following description and the drawing, which represents two embodiments. There are shown in:

FIG. 1 a longitudinal section through the end of a drainage element and its fastening, FIG. 2, an enlarged section of the filter covering fastening according to FIG. 1, FIG. 3, the filter covering fastening according to FIG. 2 with pulling action on the filter covering, FIG. 4, another form of the annular slot for the filter covering fastening according to FIG. 2 and FIG. 5 is a view similar to that of FIG. 1 but showing another embodiment of a drainage element.

As can be seen from FIG. 1, several drainage elements 2 are placed in a pressing chamber 1 of a fruit press not represented in more detail. Each drainage element 2 consists of a rod-shaped, flexible core 3 that is surrounded by a socklike filter covering 4. The ends of drainage element 2 are each inserted in a holder 6, which is placed in an opening 7 of outer wall 5 of the container to be axially immovable. Holder 6 projects with its longer part into a liquid-collecting chamber or juice collecting channel 8 that is delimited by a wall 9 or is made U-shaped. To detachably fasten drainage element 2 in holder 6, a pin 10 is provided that goes through a bore each of holder 6 and of core 3. During the pressing operation, a pressing element, for example a membrane, is moved against container wall 5 and flexible drainage elements 2 buckle and the pressed-out juice reaches core 3 through liquid-permeable filter covering 4 and is guided, by liquid channels in core 3, into the liquid-collecting chamber or juice collecting channel 8.

To fasten filter covering 4, an elastic sleeve 11 is pushed on the end of core 3, a sleeve that exhibits an outside cone 12 tapering toward pressing chamber 1. The end of filter covering 4 is pulled over sleeve 11 and is held in a annular slot 14 of sleeve 11 by a retaining ring made as O-ring 13. After this, drainage element 2 is pushed into holder 6 starting from the side of container wall 5 facing away from pressing chamber 1 until outside cone 12 of sleeve 11 with filter covering 4 pulled over it comes to lie against a corresponding inside cone 15 of holder 6. Adjacent to sleeve 11, an end plate 16 is pushed on core 3, an end plate to which is adjacent pin 10 that secures sleeve 11 axially on core 3 and, as already described, fixes the end of drainage element 2 in holder 6.

In another embodiment, the annular slot 14 may also be provided in the holder 6 as shown in FIG. 5. In this embodiment, the filter covering 4 is retained in the holder 6 by O-ring 13.

Annular slot 14 in sleeve 11 exhibits a recess angle of about 90° (FIG. 2). O-ring 13 that is inserted in annular slot 14 and that overlaps filter covering 4 is held in annular slot 14 by the inner wall of holder 6. The elastic deformations of drainage element 2 occurring during the pressing operation cause, at the fastening point of filter covering 4, considerable tensile forces that act in the direction of arrow 17 toward the outer wall 5 in FIG. 3. As a result of these tensile forces, an elastic deformation occurs on front side 18 of annular slot 14 in the pull direction, as is represented in FIG. 3. Here O-ring 13 rolls on the inner wall of holder 6 in pull direction 17 of filter covering 4 (arrow 19 in FIGS. 2 and 3) and is deformed so that it acts as a wedge and braces filter covering 4 against side 18 of annular slot 14. The bracing increases with increasing tensile force, so that also with very great loads, an assured fastening of filter covering 4 is guaranteed.

If a less elastic or nonelastic material is used for sleeve 11, it is recommended that the recess angle of annular slot 14 be selected greater than 90° (FIG. 4), to achieve the wedge effect of O-ring 13 when tensile forces occur. As represented in FIG. 4, between side 18 of annular slot 14 and the inner wall of holder 6, a wedge opening is formed into which O-ring 13 is pulled by rolling (arrow 19) on the inner wall of holder 6 during pulling actions on filter covering 4 and is deformed into a wedge that braces filter covering 4 against side 18 of annular slot 14.

It will be understood that this invention is susceptible to modification to adapt it to different usages and conditions and, accordingly, it is desire to comprehend such modifications within this invention as may fall within the scope of the appended claims.

What is claimed is:

1. Drainage element for presses for fruits, grapes or produce, in which liquids are separated from solid substances comprising a rod-shaped, flexible core (3) that is fastened within a tubular holder (6), said holder being positioned in an opening (7) in an outer wall (5) of a pressing chamber of a press, said core (3) having an end extending through said holder in said opening in said outer wall (5), a sleeve (11) surrounding said core adjacent said end of said core, a liquid-permeable filter covering (4) surrounding said core and disposed between said sleeve (11) and said holder (6), there being an annular slot (14) in one of said sleeve or said holder, said annular slot opening toward said filter covering (4) and a retaining ring (13) on said filter covering and seated in said annular slot to anchor said filter covering.

2. Drainage element according to claim 1 wherein said retaining ring (13) comprises an O-ring.

3. Drainage element according to claim 1, wherein sleeve (11) is made of an elastic material.

4. Drainage element according to claim 1 wherein said annular slot (14) in said sleeve (11) has a wall defining a recess angle ($\alpha$) with the surface of said sleeve at approximately a right angle such that covering (4) is pulled in a direction (17) toward the pressing chamber during a pressing operation.

5. Drainage element according to claim 1 wherein a wall of said annular slot (14) toward said pressing chamber has a recess angle ($\alpha$) greater than 90.

6. Drainage element according to claim 1 wherein said holder (6) has on the side of the pressing chamber a flange lying on a shoulder defined by a portion of said outer wall (5) surrounding said opening (7) and further has adjacent to the flange, a conical shape directed away from said pressing chamber and that merges into a widened cylindrical part.

7. Drainage element according to claim 6, wherein said sleeve (11) has a conical portion that can be positioned against the conical shape of holder (6).

8. Drainage element according to claim 7, wherein said sleeve (11) has cylindrical portions adjacent both ends of said conical portion.

9. Drainage element according to claim 1, wherein said sleeve (11) is axially secured on said end of the core (3) by a detachable pin (10) in a bore passing through said core (3) and said holder (6).

10. Drainage element according to claim 9, wherein an end plate (16) is disposed between said sleeve (11) and said pin (10).

11. Drainage element according to one of claim 1 to 10, wherein said retaining ring (13) defines a seal for solids.

* * * * *